United States Patent [19]

Gruenewald et al.

[11] Patent Number: 4,939,916

[45] Date of Patent: Jul. 10, 1990

[54] LOCK CONSTRUCTION

[75] Inventors: Bryan E. Gruenewald, Glendale; Clayton A. Lokken, Waukesha, both of Wis.

[73] Assignee: Briggs & Stratton Corporation, Wauwatosa, Wis.

[21] Appl. No.: 304,705

[22] Filed: Feb. 1, 1989

[51] Int. Cl.[5] ..... E05B 9/04

[52] U.S. Cl. ..... 70/373; 70/448

[58] Field of Search ..... 70/367, 368, 492, 372, 70/373, 384, 451, 448, 449, 466

[56] References Cited

U.S. PATENT DOCUMENTS

| | | | |
|---|---|---|---|
| 1,487,307 | 3/1924 | Best | 70/369 |
| 1,707,643 | 4/1929 | Segal | 70/373 |
| 2,877,638 | 3/1959 | Muttart | 70/373 X |
| 3,176,488 | 4/1965 | Jacobi | 70/373 |
| 3,209,568 | 10/1965 | Patriquin | 70/373 |
| 3,303,678 | 2/1967 | Bernard et al. | 70/373 |
| 3,548,621 | 12/1970 | Rossetti | 70/451 X |
| 3,630,054 | 12/1971 | Joensuu et al. | 70/451 X |
| 3,705,508 | 12/1972 | Fritsch et al. | 70/373 |
| 4,545,223 | 10/1985 | Poutiainen et al. | 70/368 X |
| 4,561,270 | 12/1985 | Spreng | 70/364 |

*Primary Examiner*—Gary L. Smith
*Assistant Examiner*—Suzanne L. Dino
*Attorney, Agent, or Firm*—Andrus, Sceales, Starke & Sawall

[57] ABSTRACT

A lock construction including an outer case having a central opening that receives a cylinder. A plurality of plate-type tumblers are mounted for sliding movement within a passage in the cylinder and the tumblers have aligned slots to receive a key. The side wall of the case is provided with a longitudinal opening or window and a pair of shoulders border opposite sides of the opening. A cover encloses the opening and has a pair of side flanges that removably engage the shoulders of the case. In assembling the lock, the tumblers are inserted into the cylinder through the opening in the case and the cylinder is then rotated to effect engagement of the tumblers with the ward in the case, which is spaced 90° from the opening, and the cover is then snap-fitted onto the case. By removal of the cover, the tumblers can be readily removed from the cylinder.

10 Claims, 1 Drawing Sheet

LOCK CONSTRUCTION

BACKGROUND OF THE INVENTION

In the production of automotive locks, the locks are commonly produced in sets of five, including two-door locks, an ignition lock, a trunk or deck lock, and a glovebox lock, and the locks are run in batches of twenty locks with the same coding. If any lock in the batch is shown to be defective, the entire batch is scrapped, as it is not economically feasible to repair the defective lock. For example, in order to repair a defective lock it would be necessary to remove the pawl and clip, the spring cap, the shutter unit and the shutter springs, and then remove the loaded cylinder from the case to change the tumblers. With high production rates as is required for automotive locks, it is not feasible to carry out this labor intensive process to repair the defective lock, with the result that the entire batch is scrapped.

U.S. Pat. No. 3,306,678 is directed to a pin tumbler lock having an opening in the case which is enclosed by a plastic cap. The pin tumblers extend into the opening in the case and a spring is interposed between the end of each pin and the cap. Due to the spring pressure against the cap, the cap is permanently secured to the case through a pinching or upsetting operation. The purpose of the cap in the aforementioned patent is to prevent entry of water into the pin tumbler chambers.

SUMMARY OF THE INVENTION

The invention is directed to a lock construction having an opening in the side wall of the case which is enclosed by a removable cover. More specifically, the side wall of the case is formed with a longitudinal opening or window and the walls of the case bordering the opening are provided with overhanging shoulders. A cover or cap, preferably formed of a plastic material, is removably attached to the case and encloses opening. The cover is provided with an inner generally curved wall which forms a continuation of the inner wall of the case, and the cover is with a pair of side flanges having inwardly extending lips that removably engage the shoulders on the case to lock the cover to the case.

The forward end of the cover is provided with a generally flat surface, which engages a transverse wall on case, while the rear end of the cover is formed an inclined surface which rides against the rear edge of the case bordering the opening and serves to wedge cover forwardly as the cover is assembled with the case.

In assembling the lock, the cylinder is inserted the case and the tumblers and springs are then inserted through the opening in the side wall of the case into position within the cylinder. The cylinder is then rotated relative to the case by use of a key or blade, causing the outer ends of the tumblers to engage a ward in the case, which is circumferentially spaced from the opening in the case. The cover can then removably attached to the case to complete the assembly.

The invention greatly improves the servicing of the lock and enables the tumblers to be removed and replaced merely removing the cover and rotating the cylinder the tumblers are aligned with the opening in the side wall of the case. This is a substantial advantage over conventional-type locks in which it is remove the pawl and clip, spring cap, shutter and springs, before the loaded cylinder can be from the case for replacement of the tumblers. This not only improves after-market servicability, but enables the defective lock to be repaired on the line, thereby eliminating the costly procedure of scrapping an entire batch in the event one of the locks in the batch is defective.

The invention permits coding of a complete lock assembly instead of having to do coding early in the assembly process. This eliminates the problem of keeping the coded locks from being mixed as they go through the assembly process for either mass or special orders.

The invention also permits all functions of the lock to be tested before coding so that repairs or changes can be made without dismantling the entire lock. Further, no inventory or tracking of codes is necessary before packaging, so that the production process requires less computer memory as there is no matching of completed locks.

As an added feature, an outer rib can be incorporated with the cover which serves an an antirattle device.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
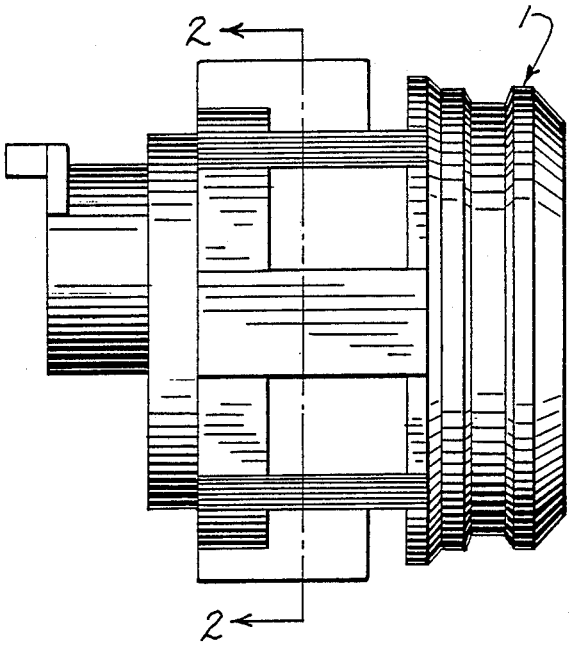
FIG. 1 is a side elevation of a lock incorporating the invention.

The drawings illustrate a key actuated lock, such as an automotive lock, that includes an outer case 1 and a cylinder 2 is mounted for rotation within the central opening of the case. The inner end of the cylinder projects beyond the case and is adapted to be connected by a conventional linkage to a working member to perform a working function.

Cylinder 2 is provided with a central opening 3 and a plurality of plate-type tumblers 4 are mounted for transverse sliding movement within opening 3. Each tumbler 4 is provided with an elongated slot 5 and the slots 5 are aligned and are adapted to receive a key, not shown.

Each tumbler 4 is provided with a laterally extending lug 6 and a spring 7 is interposed between the lug 6 and a surface 8 on cylinder 2. The force of spring 7 will urge the outer ends 9 of the tumblers 4 into engagement with a ward or recess 10 in the case 1. The cylinder and the tumbler construction of the lock is conventional.

Figure 2:
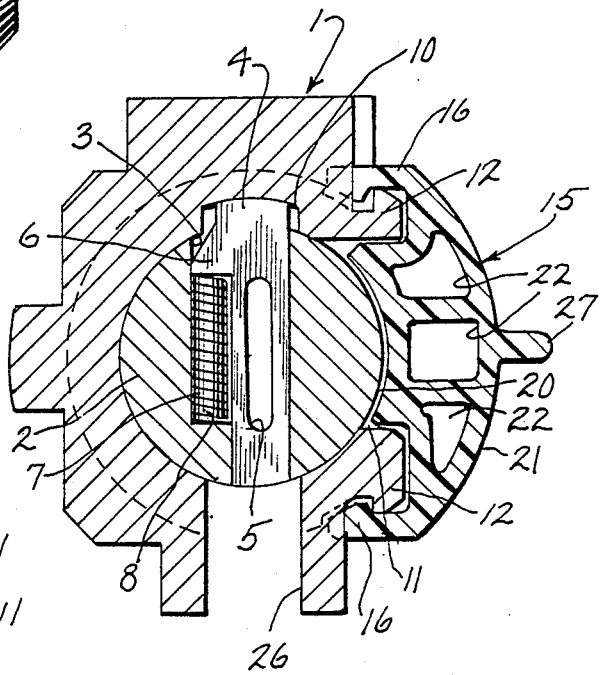
FIG. 2 is a section taken along line 2—2 of FIG. 1.
Figure 3:
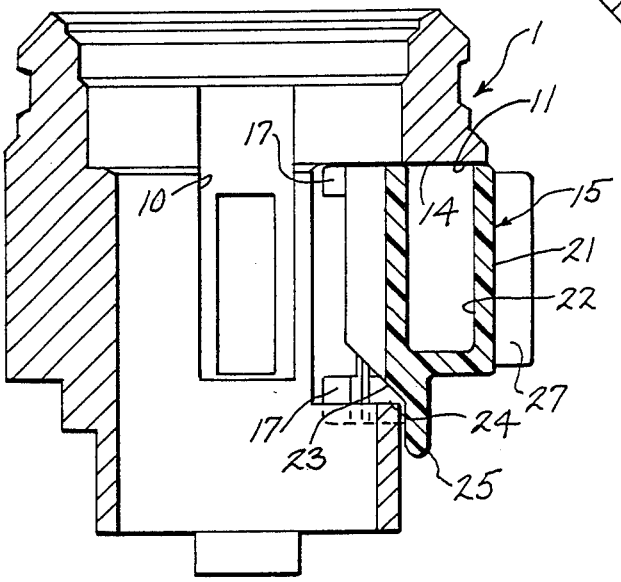
FIG. 3 is a longitudinal section of the case and cover with the cylinder removed.

In accordance with the invention, the side wall of case 1 is provided with an elongated window or opening 11, as best shown in FIGS. 2 and 3. The walls of case 1 bordering opening 11 are formed with outwardly extending shoulders 12 which overhang recesses 13.

The forward end of opening 11 is bordered by laterally extending wall 14 of case 1, as best shown in FIG. 3.

Figure 4:
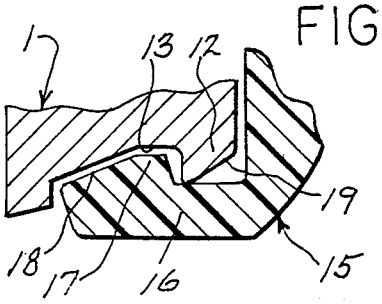
FIG. 4 is a fragmentary enlarged view showing the locking connection between the cover and the case.

A cover or cap 15, preferably formed of a flexible plastic material, is removably engaged with case 1 and encloses opening 11. As best shown in FIG. 4, cover 15 is provided with a pair of side flanges 16 which terminate in inwardly facing lips 17. As the cover 15 is installed with case 1, the inclined surfaces 18 bordering lips 17 will ride along the sloping edges 19 of shoulders 12 of the case, thereby spreading the side flanges 16 apart. The lips 17 will then snap into engagement with the recesses 13 to hold the cover in position.

As shown in FIG. 2, cover 15 is provided with a curved inner surface 20 which forms a continuation to the cylindrical inner wall of case 1, and the outer surface 21 of the cover is also curved between the flanges 16.

As a material saving, cover 15 can be provided with a plurality of longitudinal recesses 22.

As shown in FIG. 3, the rear end of cover 15 is formed with an inclined surface 23 which is adapted to engage the rear edge 24 bordering opening 11 as the cover is installed, and the engagement of the inclined surface 23 with edge 24 will serve to wedge the cover forwardly to bring the forward end of the cover into tight engagement with the transverse wall 14 of case 1.

As shown in FIG. 3, the rear end of cover 15 can be formed with a rearwardly extending shield 25 which overhangs the joint between surface 23 and edge 24 and prevents water or other foreign material from entering the lock through the joint.

In addition, a drain opening 26 is located diametrically opposite ward 10 in the case and serves to drain water or moisture from the lock.

As an added feature, cover 15 can be formed with an outwardly extending anti-rattle rib 27 which is adapted to engage an outer housing, not shown, and prevent rattling of the lock with the housing.

To assemble the lock, cylinder 2 is inserted within the central opening in case 1 and is oriented so that the tumblers 4 and springs 7 can then be inserted With the tumblers and springs installed in the cylinder, the cylinder is rotated through use of a key or blade, and rotation of 90° will cause the outer ends 9 of the tumblers 4 to engage the ward 10 in the case. Cover 15 can then be snap-fitted in position to enclose opening 11.

If it is necessary to repair or replace the tumblers 4, cover 15 is removed and the cylinder is rotated to bring the tumblers into registry with the opening 11. The tumblers 4 and springs 7 can then be removed as necessary and replaced. This greatly simplifies the service of the lock in that it is not necessary to remove the pawl and clip, spring cap, shutter unit and springs, and the cylinder from the case in order to remove and replace the tumblers. Not only does the invention aid in serviceability, but because of the simplification of repair, it enables a defective lock to be repaired on the line, thus eliminating the common procedure of scrapping an entire batch in the event one lock of the batch is defective.

As a further advantage, all of the working components of the lock can be tested before the tumblers are installed. With the procedure as used in the past, the completed lock was tested for operability, and if it was defective there was no immediate indication as to whether the defect resided in the tumblers or other operating parts of the lock.

The invention also enables "just in time" production processes to be employed which substantially reduces inventory, and when dealing with high volume locks, such as automotive locks, this is a substantial economic advantage.

Various modes of carrying out the invention are contemplated as being within the scope of the following claims particularly pointing out and distinctly claiming the subject matter which is regarded as the invention.

We claim:

1. In a lock construction, a case having a central aperture and having a ward communicating with said aperture, said ward having a bottom surface spaced radially outward of said aperture, a cylinder disposed within the aperture and having a central passage, a plurality of plate-like tumblers disposed within the passage and having aligned slots to receive a key, each tumbler having an end disposed to be received in said ward, spring means connecting each tumbler plate at a location spaced from said end and said cylinder for biasing said end outwardly into engagement with the bottom surface of said ward, said case having an opening in a side thereof communicating with the central aperture and spaced circumferentially from said ward, a pair of shoulders bordering opposed sides of said opening, and a cover to enclose said opening, said cover having side flanges constructed and arranged to removably engage the shoulders, said cover being removable from said opening to permit insertion and removal of said tumblers from said cylinder.

2. The lock construction of claim 1, wherein the case is provided with a longitudinal recess disposed outwardly adjacent each of said shoulders, each shoulder projecting outwardly beyond the respective recess, each flange being provided with a lip disposed to engage the respective recess to lock said cover to said case.

3. The lock construction of claim 1, wherein said cover has a first end disposed in engagement with a lateral surface of said case and said cover has a second opposite end having an inclined surface constructed and arranged to ride against an edge of the case bordering said opening to thereby wedge said first end of said cover against said lateral surface.

4. The lock construction of claim 1 wherein said ward is spaced about 90° from said opening.

5. The lock construction of claim 6, and including a drain opening in said case disposed diametrically opposite said ward.

6. The lock construction of claim 3, and including a shield extending outwardly from the second end of said cover to overlie the joint between said second end and said edge.

7. The lock construction of claim 1, wherein said cover has a curved inner surface forming an extension to the cylindrical wall of said case.

8. The lock construction of claim 2, and including an inclined surface disposed on each flange adjacent the lip and disposed to engage the respective shoulder as the cover is assembled with the case to wedge said side flanges outwardly.

9. The lock construction of claim 1, and including a rib extending outwardly from the outer surface of said cover and adapted to engage an outer housing.

10. In a lock construction, a case having a central aperture and having a ward communicating with said aperture, said ward having a bottom surface spaced radially outward of said aperture, a cylinder disposed within the aperture and having a central passage, a plurality of plate-like tumblers disposed within the passage and having aligned slots to receive a key, each tumbler having an end disposed to be received in said ward, spring means connecting each tumbler plate at a location spaced from said end and said cylinder for biasing said end outwardly into engagement with the bottom surface of said ward, said case having an opening in a side thereof communicating with the central aperture and spaced circumferentially from said ward, a pair of shoulders bordering opposed sides of said opening, and a cover to removably enclose said opening, said case having a radially extending surface bordering said opening, said cover having a first end disposed in engagement with said radially extending surface and having an opposite end, and wedge means associated with said opposite end to wedge said first end of said cover against said radially extending surface.

* * * * *